United States Patent [19]

Nohmura

[11] 4,055,170

[45] Oct. 25, 1977

[54] HEALTH PROMOTING APPARATUS

[76] Inventor: Ryotaro Nohmura, No. 19-19, 3-chome, Senriyama-nishi, Suita, Osaka, Japan

[21] Appl. No.: 707,606

[22] Filed: July 22, 1976

[51] Int. Cl.[2] ..... A61H 1/00

[52] U.S. Cl. ..... 128/33

[58] Field of Search ..... 128/33, 32, 24 R, 25 R, 128/24.2

[56] References Cited

U.S. PATENT DOCUMENTS

| | | | |
|---|---|---|---|
| 2,893,380 | 7/1959 | Walker et al. | 128/25 R |
| 2,982,341 | 5/1961 | Besser | 297/DIG. 3 |
| 3,235,891 | 2/1966 | Chade et al. | 128/33 |
| 3,309,083 | 3/1967 | George et al. | 128/25 R |
| 3,556,088 | 1/1971 | Leonardini | 128/33 |

*Primary Examiner*—Lawrence W. Trapp

*Attorney, Agent, or Firm*—Wenderoth, Lind & Ponack

[57] ABSTRACT

A health promoting apparatus comprising a chair, bed or the like with a loudspeaker incorporated therein. An opening formed in the chair is closed by a pretensioned flexible sheet. The sound waves from the loudspeaker cause the flexible sheet to vibrate, said vibrations being transmitted to a chair occupant.

4 Claims, 6 Drawing Figures

HEALTH PROMOTING APPARATUS

The present invention relates to an improved health promoting apparatus comprising a chair, bed or the like with a loudspeaker incorporated therein.

The health promoting apparatus of this type in which vibrations are given to the occupant body by propagation of sound waves generated by the loudspeaker is known from my U.S. Pat. No. 3,880,152. The present invention provides improvements in such an apparatus.

Conventional apparatuses of this type were less effective for health promotion and failed to arouse much interest to the user because they can impart only regular, monotonous vibrations to the occupant body.

An object of the present invention is to provide an improved health promoting apparatus which can give irregular vibrations more effectively to the occupant body from a loudspeaker through a pretensioned flexibel sheet.

Another object of the present invention is to provide an improved health promoting apparatus which permits easy adjustment of intensity of vibrations given according to the user.

A further object of the present invention is to provide an improved health promoting apparatus which can give vibrations of greater irregularity or variation.

Other objects and advantages of this invention will become apparent from the following description taken in connection with the accompanying drawings wherein.

Figure 1:
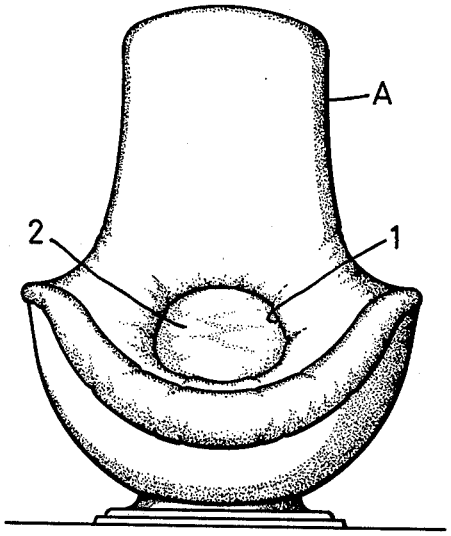
FIG. 1 is a front view of a health improving chair according to the present invention.
Figure 2:
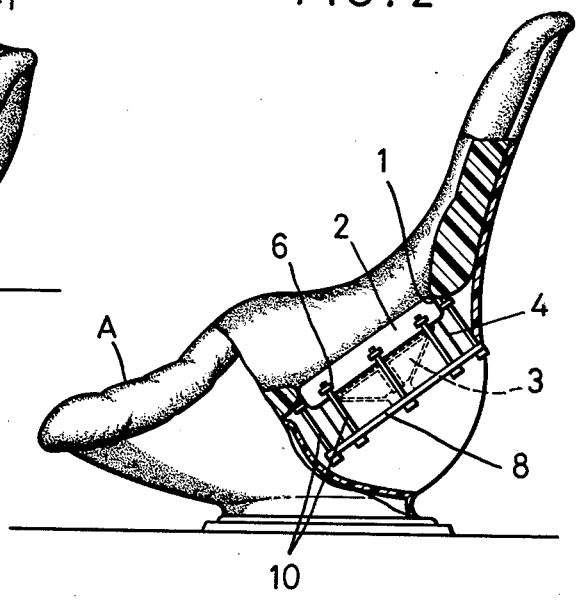
FIG. 2 is a partially cutaway side view of the chair of FIG. 1.
Figure 3:
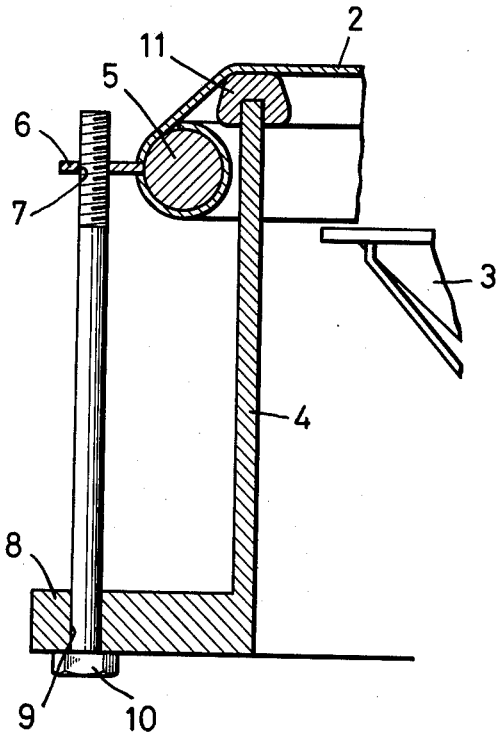
FIG. 3 is an enlarged vertical sectional front view of a portion of the chair of FIG. 1.

Referring first to FIGS. 1-3, reference A designates a chair comprising a hollow supporting structure formed with an opening 1 at the seat portion on which the occupant rests. The opening 1 is closed by a pretensioned flexible sheet 2 made of natural or synthetic leather or other similar material and stretched through a pad 11 over the upper end of a tubular member 4 fixedly mounted in the chair so as to be directed to the opening 1.

A loudspeaker 3 is mounted in the tubular member 4 by means of a supporting arm with its front directed to the rear of the flexible sheet 2 with a slight spacing therefrom.

The peripheral portion of the sheet 2 is wound around a ring 5 vertically movably mounted on the tubular member 4 at its top and is fastened thereto by cords, rivets or other means. The ring 5 is provided with several projections 6 arranged with regular intervals and extending radially from its outer periphery. Each of the projections 6 is formed with a threaded hole 7. The tubular member 4 has a flange 8 at its bottom formed with through holes 9 in alignment with the threaded holes 7 in the projections 6 to receive bolts 10. The latter is passed through the hole 9 and threaded through the hole 7 in each projection 6. By turning the bolts 10, the ring 5 can be raised and lowered to adjust the tension to the flexible sheet 2. Conveniently, the bolts 10 are turned with a box spanner from external.

Figure 4:
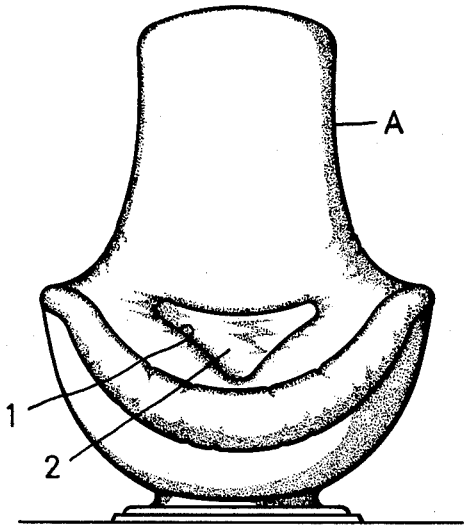
FIG. 4 is a front view of the second embodiment.
Figure 5:
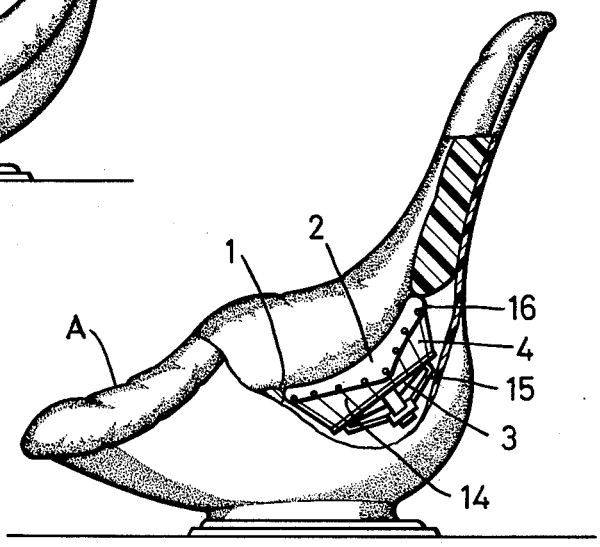
FIG. 5 is a partially cutaway side view of the second embodiment.
Figure 6:
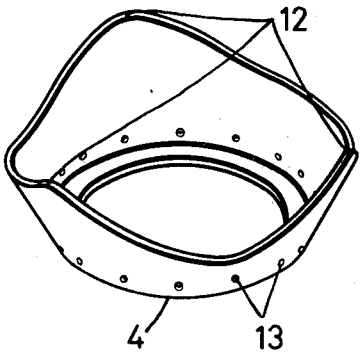
FIG. 6 is a perspective view of the tubular member used in the second embodiment.

Referring to FIGS. 4, 5 and 6 illustrating the second embodiment of this invention, an opening 1 of a substantially triangular shape formed in the chair is smilarly closed by a pretensioned flexible sheet 2 stretched on a tubular member 4. The latter has its upper edge elevated at three portions 12 disposed with regular angular intervals as shown in FIG. 6. Two or more than three elevated portions instead of three may be provided, with an opening 1 of an accordingly multiangular shape.

The flexible sheet 2 is pretensioned by cords 14, which have one end fastened to holes 16 in the sheet 2 and the other end tied to holes 13 formed in the tubular member 4 at its bottom with regular intervals. The loudspeaker 3 is mounted on a supporting arm 15 inside the tubular member 4 with its front slightly spaced from the flexible sheet 2.

In either of the embodiments, the loudspeaker 3 is connected through a wire to an external audio amplifier connected to a record player, a tape deck, a radio receiver or the like.

During use, the body of a chair occupant bears against the flexible sheet 2. By operating the record player or the like, the sound vibrations eminating from the loudspeaker are transmitted through the flexible sheet 2 to the occupant body as irregular but rhythmical vibrations.

It has been proved that giving such vibrations to the human body has a massaging effect, thus improving blood circulation and the function of internal organs. Since the flexible sheet 2 is pretensioned, vibrations are more effectively transmitted to the human body.

In the first embodiment, the tension given to the flexible sheet 2 is adjustable according to the user. The larger the tension given, the stronger vibrations are generated.

In the second embodiment, since the tubular member 4 has elevated portions 12, the flexible sheet 2 extended thereover is more tightly tensioned at and adjacent these elevated portions than at the lower portions therebetween. Generally, it has been found that stronger vibrations are generated at highly tensioned areas than at less tensioned ones. Also, more irregular vibrations are produced when and where stronger vibrations meet weeker ones. Further, due to the fact that the sound waves from the loudspeaker hit not a plane but a curved surface, irregular vibrations are generated. Thus, the provision of elevated portions on the tubular member makes it possible to generate vibrations of more irregularity or variation.

While in the preferred embodiments the present invention is applied to a chair, it is not limited to a chair but covers a bed, mattress or the like.

While preferred embodiments have been described, variations thereto will occur to those skilled in the art within the scope of the present invention.

What is claimed is:

1. An apparatus for health promotion comprising:

a hollow supporting structure for supporting a human body resting on said apparatus, said supporting structure formed with an opening at a seat portion on which the occupant rests, a tubular member mounted inside said supporting structure so as to be directed toward said opening, flexible sheet means stretched over the upper end of said tubular member so as to close said opening;

means for pretensioning said flexible sheet means; and a loudspeaker mounted inside said tubular member so as to be slightly spaced from, and directed toward, said flexible sheet means, whereby sound vibrations eminating from said loudspeaker cause said flexible sheet means to vibrate.

2. An apparatus for health promotion claimed in claim 1 wherein said pretensioning means is constituted by a ring vertically movably mounted on said tubular member, said flexible sheet means being fastened to said ring, and further comprising means for raising and lowering said ring to adjust the tension of said flexible sheet means.

3. An apparatus for health promotion claimed in claim 1 wherein said pretensioning means is constituted by cords.

4. An apparatus for health promotion claimed in claim 1 wherein said tubular member has its upper edge elevated at at least two portions, said opening being of a multiangular shape accordingly, whereby giving the occupant vibrations of more irregularity.

* * * * *